US005322118A

United States Patent [19]

Terrell

[11] Patent Number: 5,322,118

[45] Date of Patent: Jun. 21, 1994

[54] DOWNHOLE CHEMICAL CUTTER

[76] Inventor: Jamie B. Terrell, 1916 Christopher Dr., Ft. Worth, Tex. 76140

[21] Appl. No.: 899,628

[22] Filed: Jun. 16, 1992

[51] Int. Cl.[5] ..... E21B 29/02

[52] U.S. Cl. ..... 166/55; 166/63; 166/212

[58] Field of Search ..... 166/55, 55.2, 63, 212

[56] References Cited

U.S. PATENT DOCUMENTS

| | | | |
|---|---|---|---|
| 2,918,125 | 12/1959 | Sweetman | 166/35 |
| 4,125,161 | 11/1978 | Chammas | 166/55 X |
| 4,315,797 | 2/1982 | Peppers | 166/55.2 X |
| 4,345,646 | 8/1982 | Terrell | 166/55 |
| 4,415,029 | 11/1983 | Pratt et al. | 166/212 |
| 4,494,601 | 1/1985 | Pratt et al. | 166/55 |
| 4,613,394 | 9/1986 | Terrell et al. | 166/55.2 X |
| 4,619,318 | 10/1986 | Terrell et al. | 166/55 |
| 4,620,591 | 11/1986 | Terrell et al. | 166/63 |
| 4,971,146 | 11/1990 | Terrell | 166/212 X |

*Primary Examiner*—Ramon S. Britts
*Assistant Examiner*—Frank S. Tsay
*Attorney, Agent, or Firm*—Hubbard, Tucker & Harris

[57] ABSTRACT

Chemical cutting tool for use within a well bore for cutting very small diameter tubular goods. The tool has an elongated tool body having anchoring means for anchoring the tool within a conduit and a pressure generating section. A cutting section of the tool body has a longitudinal bore having at least one cutting port for expelling cutting agent. A chemical section in the tool body is between the pressure generating section and the cutting section. The chemical section includes a casing having a chamber containing a source of fluid cutting agent. The tool further comprises closure means at at least one end of the casing. The closure means comprises a diaphragm body which is inserted into one end of the casing by an interference fit and which has spaced transverse rupture diaphragms. One of the rupture diaphragms fits into the diaphragm body in an interference fit. The other rupture diaphragm may fit into the tool body in an interference fit, or may be formed integrally. The casing of the chemical section has an internal shoulder and an internally threaded box connection extending outwardly from the shoulder. A tubular body having a diaphragm, has a reduced portion which fits into the casing in the interference fit and an upset shoulder. An annular sealing ridge on the shoulder surrounds the rupture diaphragm and interacts with a metal washer to form a seal.

21 Claims, 3 Drawing Sheets

DOWNHOLE CHEMICAL CUTTER

TECHNICAL FIELD

This invention relates to systems and processes for the cutting of downhole tubular goods and more particularly to such processes and systems which can be used to form cuts in high strength, high temperature alloy tubular goods.

BACKGROUND OF THE INVENTION

There are many circumstances in the oil industry where it is desirable to cut into or through downhole tubular goods within a well. For example, in the course of drilling a well, the drill pipe may become stuck at a downhole location. This may result from "keyseating" or as a result of cuttings which settle within the well around the lower portion of the drill string. In order to remove the drill string from the well, it may be necessary to sever the drill pipe at a location above the stuck point. Similarly, it is often necessary to carry out downhole cutting operations during the completion or operation or abandonment of oil or gas wells. For example, it is sometimes desirable to sever casing or tubing at a downhole location in order to make repairs or withdraw the tubular goods from a well which is being abandoned or repaired. In most cases, the pipe is reusable. In other circumstances, it is desirable to cut slots, grooves or perforations in downhole tubular goods. Thus, it is a common expedient to perforate the casing and surrounding cement sheath of a well in order to provide fluid access to a hydrocarbon bearing formation. Similarly, it is sometimes desirable to perforate tubing in the completion or recompletion of a well.

Chemical cutters can be used to significant advantage in the application of chemicals to cut, sever or perforate downhole tubular goods. For example, U.S. Pat. No. 2,918,125 to Sweetman discloses a downhole chemical cutter which employs cutting fluids that react violently with the object to be cut with the generation of extremely high temperatures sufficient to melt, cut or burn the object. In the Sweetman procedure, halogen fluorides are employed in jet streams impinging on the downhole pipe to sever or perforate the pipe. The attendant reaction is highly exothermic and the pipe is readily penetrated. Examples of chemical cutting agents disclosed in Sweetman are fluorine and the halogen fluorides including such compounds as chlorine trifluoride, chlorine monofluoride, bromine trifluoride, bromine pentafluoride, iodine pentafluoride and iodine heptafluoride. The cutting agent in the Sweetman device is contained within a chemical container portion of the tool comprising a tubular body closed at its upper and lower ends with threaded connect subs. Each connector sub has a threaded counter bore terminating in a shoulder to which a rupturable shear disk is seated. The shear disks are held in place by means of externally threaded jam nuts. A pressure sub is located above the chemical section and contains a suitable explosive propellant. With ignition of the propellant material, sufficient gas pressure is injected to rupture the upper shear disk and thence the lower shear disk with the attendant displacement of cutting agent into an ignitor sub which contains suitable ignitor material such as sequential bodies of steel wool of progressively increasing coarseness and decreasing density. The cutting agent is then displaced into a discharge head where it is expelled from the tool through radial ports in jet cutting streams.

In Sweetman, the cutting ports extend radially from a central bore within the discharge head of the cutting tool which terminates in a reduced diameter bore which is open to the lower or front end of the cutting tool. The reduced diameter bore is internally threaded to receive a threaded plug which closes the lower end of the bore.

Another chemical cutting tool is disclosed in U.S. Pat. No. 4,345,646 to Terrell. In this tool, a chemical module assembly is closed at its upper and lower ends by means of rupture diaphragms held in place by diaphragm retainers threaded into the chemical module sub. The rupture diaphragm is constructed with an area of reduced cross-section in order to facilitate rupturing at a specified pressure differential in order to more or less completely open the area of the diaphragm to facilitate the discharge of the chemical cutting agent.

Another chemical cutting tool is disclosed in U.S. Pat. No. 4,620,591 to Terrell et al. Here, the chemical sub assembly contains dual diaphragm seals at the opposed ends thereof. The dual diaphragm seals include upper and lower rupturable membranes which are separated by a dead air space. The dual diaphragm seal is held in place by means of an internal sleeve having external threads, which is threaded into place within the internal pin sections of the chemical sub.

As further disclosed in U.S. Pat. No. 4,619,318 to Terrell et al., objects may be perforated or in some instances, completely dissolved with no debris left in the well through the use of a downhole chemical cutter. As disclosed in this patent, the chemical cutting tool may be provided with a downwardly extended nozzle provided with a suitable stand-off sleeve. In addition to the halogen fluoride cutting agents as disclosed in the aforementioned patent to Sweetman, further cutting agents as disclosed in the Terrell et al. patent include nitrogen fluoride sources.

Yet another chemical cutting tool is disclosed in U.S. Pat. No. 4,494,601 to Pratt et al. Here, a lower part of the cutting head structure is open to well fluid and a piston plug is interposed immediately above the cutting ports. The cutting ports may be closed to the exterior of the well by means of an internal sleeve positioned in the bore of the cutting head immediately in front of the piston. As in the cutting tools described above, the cutting ports lie in a single plane perpendicular to the centerline of the tool.

SUMMARY OF THE INVENTION

In accordance with the present invention there is provided a new downhole chemical cutting tool of the type adapted to be inserted into a well bore and which is particularly well suited for use in cutting very small diameter tubular goods. The chemical cutting tool of the present invention has an elongated tool body having anchoring means for anchoring the cutting tool within a conduit and a pressure generating section. A cutting section of the tool body has a longitudinally extending bore therein having at least one cutting port through which cutting agent may be dispelled from the bore to the exterior of the tool body to perform a cutting function. A chemical section in the tool body is interposed between the pressure generating section and the cutting section. The chemical section is formed of a casing having a chamber therein which is adapted to contain a source of fluid chemical cutting agent. The tool further comprises closure means at at least one end of the casing for closing the chamber. The closure means comprises a diaphragm body which is inserted into one end of the casing by an interference fit and which has at least one transverse rupture diaphragm.

Preferably, the diaphragm body has at least two spaced rupture diaphragms. In one aspect of the invention, one of the rupture diaphragms fits into the diaphragm body in an interference fit. The other rupture diaphragm may similarly fit into the tool body in an interference fit, or alternatively, may be formed integrally with the diaphragm body.

In a further aspect of the invention, the casing of the chemical section has an internal shoulder and an internally threaded box connection extending outwardly from the shoulder. The tubular body which carries the rupturable diaphragms, has a reduced diameter portion which fits into the casing in the interference fit and an enlarged diameter portion defining an upset shoulder which is in an abutting relationship with the internal casing shoulder. The shoulder portion of the tubular member further comprises an annular sealing ridge which surrounds the rupture diaphragm and is internal of the threaded box so that it can interact with a sealable metal washer to form an effective seal.

DESCRIPTION OF THE PREFERRED EMBODIMENTS

During the course of the cutting operation, a high pressure gas is generated in the chemical cutter that forces the chemical from the steel storage tube (referred to henceforth as chemical modules) by rupturing the metal diaphragms. The chemical is then ejected through the cutting ports of the head, which are centrally located on the circumference of the head, and thence to the interior surface of the pipe that is to be cut. The aforementioned U.S. Pat. No. 4,345,646 to Terrell discloses an effective dual diaphragm assembly for sealing the chemical module of a chemical cutting tool. A threaded diaphragm mounting device is employed to anchor a pair of metal rupture diaphragms at each end of the chemical module. Two metal diaphragms are threadedly held in a sealing configuration by a mounting device which takes the form of a cylindrical, threaded composite wedge that only sealably anchors the rupture diaphragms, but separates each pair of rupture diaphragms by an air space. This diaphragm assembly disclosed in the Terrell patent actually allows each rupture diaphragm to independently accomplish the sealing function as a "dual" diaphragm seal, at each end of the chemical module.

The present invention provides an equally effective system of providing a dual diaphragm seal on one or both ends of the chemical module which is particularly well suited to small diameter cutting tools, particularly cutting tools having an outer diameter of about ¾ inch or less which can be used for cutting small diameter tubing of about one inch. This is accomplished by employing a press fit diaphragm assembly into each end of the chemical module with an interference fit between the outer diameter of the diaphragm assembly and the inside diameter of the chemical module casing. To accomplish this interference fit, the outside diameter of the diaphragm assembly should be 0.0005 to 0.0015 inch larger than the inside diameter of the chemical module. This arrangement for sealing the chemical module results in a less expensive, shorter threaded bore at each end of the chemical module. Also, the press fit diaphragm is constructed without the need for threaded mounting means, resulting in significant cost savings. Since the chemical modules present a significant expense in making a cut, the present invention provides a real savings in the cost of the chemical cutting of pipe.

Figure 1:
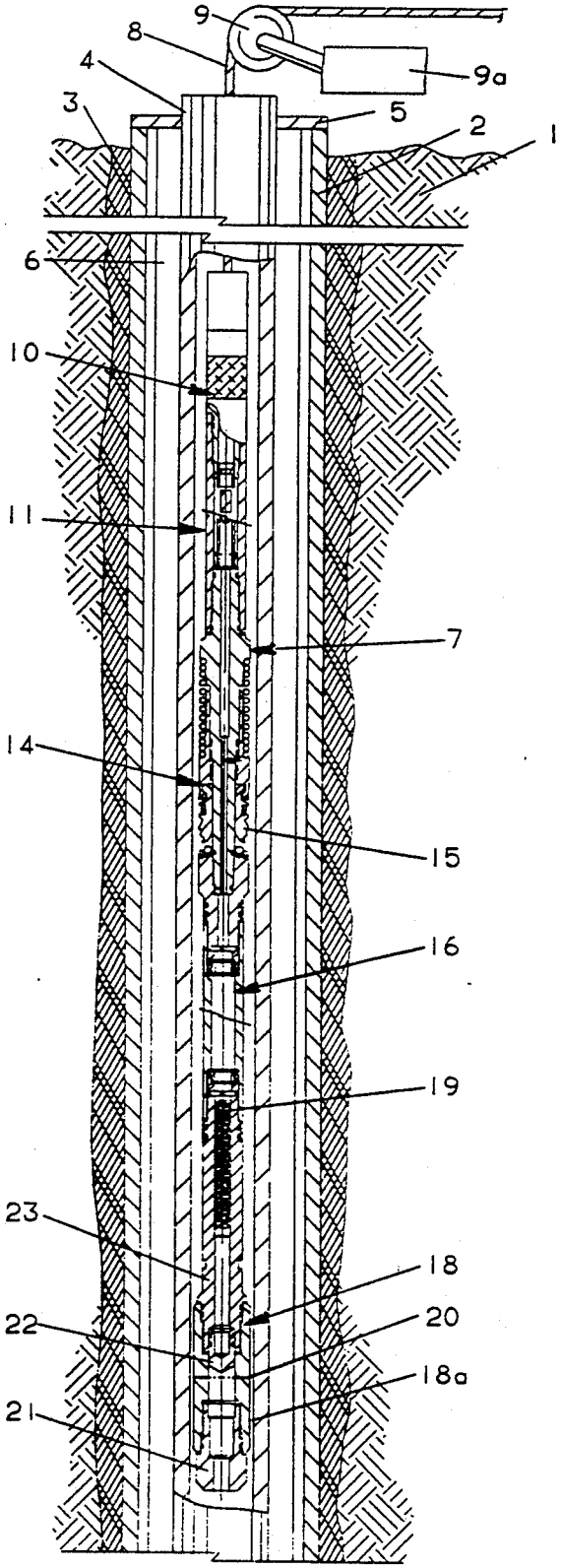
FIG. 1 is an illustration, partly in section, showing a downhole chemical cutting tool located in a well.

For a further description of the present invention, reference will be made to the drawings with regard to which the invention will be described in detail. As shown in FIG. 1 of the drawings, there is illustrated a chemical cutting tool embodying the present invention disposed within a well extending from the surface of the earth to a suitable subterranean location, e.g., an oil and/or gas producing formation (not shown). More particularly, and as is illustrated in FIG. 1, a well bore 1 is provided with a casing string 2 which is cemented in place by means of a surrounding cement sheath 3. A production tubing string 4 is disposed in the well as illustrated and extends from the well head 5 to a suitable downhole location. The tubing string and/or the annular space 6 between the tubing and the casing may be filled with high pressure gas and/or a liquid such as oil or water. Alternatively, the tubing string 4 or the annulus 6 may be "empty", i.e., substantially at atmospheric pressure.

As further illustrated in FIG. 1, there is shown a chemical cutting tool 7 which is suspended from a cable (wireline) 8. The cable 8 passes over suitable indicating means such as a measuring sheave 9 to a suitable support and pulley system. The measuring sheave produces a depth signal which is applied to an indicator 9*a* which gives a readout of the depth at which the tool is located. It will, of course, be recognized that the well structure illustrated is exemplary only and that the cutting tool 7 can be employed in numerous other environments. For example, instead of a completed well, the tool can be employed in severing a drill pipe in either a cased or uncased well. In this case, the tubing string 4 shown would be replaced by a string of drill pipe.

The chemical cutter 7 is composed of five sections. At the upper end of the tool there is provided a fuse assembly 10 comprised of a fuse sub and an electrically activated fuse (not shown). Immediately below the fuse assembly 10 is a propellant section 11 which provides a source of high pressure gas. For example, the propellant section 11 may take the form of a chamber containing a propellant, such as gun powder pellets, which burns to produce the propellant gases. Immediately below the propellant section 11 is a slip section 14 incorporating a slip array 15 that anchors the tool during the cutting cycle. A chemical module section 16 is located below the slip section 14. This section contains a suitable chemical cutting agent. Preferably, the chemical cutting agent will take the form of a halogen fluoride, more preferably, bromine trifluoride. Immediately below the chemical module section 16 is a head assembly 18. This section contains an "ignitor hair" 19 such as steel wool, preferably a mixture of steel wool and alloy shavings as described below, which activates the halogen fluoride, bringing it to a temperature that will quickly cut the tubing 4. The head assembly 18 also contains cutting ports 20 through which the fluid is directed against the interior wall of the tubing string 4. In the embodiment shown, the head section is equipped with the ports 20 extending about the periphery thereof to completely sever the tubing string 4 in the well. The port holes are arranged in a plurality of converging planar patterns generally normal to the major axis of the tool body. This arrangement greatly facilitates the severing of hard-to-cut high temperature alloy materials as described below.

The head assembly 18 includes a bull nose sub 21 which is threadedly secured into a cutting head 18*a* containing the ports 20 and which is open at its lower end to provide a continuation of the central bore extending through the head assembly which is open to the well bore. A piston plug 22 is disposed in the central bore of the cutting head immediately above the level of the cutting ports 20. As described below, the piston plug is driven downwardly to a position below the cutting ports, and is wedged into slightly reduced diameter section of the bore as described in greater detail in the aforementioned U.S. Pat. No. 4,494,601 to Pratt and Terrell.

The operation of the chemical cutter tool 7 may be described briefly as follows. The tool is run into the well on the wireline 8 to the desired depth at which the cut is to be made. An electric signal is then sent via wireline 8 to the chemical cutter tool 7 where it sets off the fuse, in turn igniting the propellant. As the propellant burns, a high pressure gas is generated and travels downward through the slip section 14 and forces the slip array 15 outwardly in a manner described hereinafter. The slip array 15 thus anchors the chemical cutter tool 7 in the tubing string 4. As the gas pressure further increases, seal diaphragms within the chemical module section 14 are ruptured and the halogen fluoride or other cutting agent is forced through the ignitor hair 19 which ignites the chemical. The gas pressure then forces the activated chemical cutting agent into the head section 18 and ultimately outwardly through cutting ports 20. In a short period of time, normally less than a second, the tubing 4 is severed and the slip array 15 is retracted so that the chemical cutter tool 7 can then be withdrawn from the tubing string 4. For a further description of the general operating conditions and parameters employed in the chemical cutter tool 7, reference may be made to the aforementioned U.S. Pat. Nos. 4,494,601 and 4,345,646 to Terrell and 4,415,029 and U.S. Pat. No. 4,619,318 to Pratt and Terrell, the entire disclosures of which are incorporated herein by reference.

Figure 2:
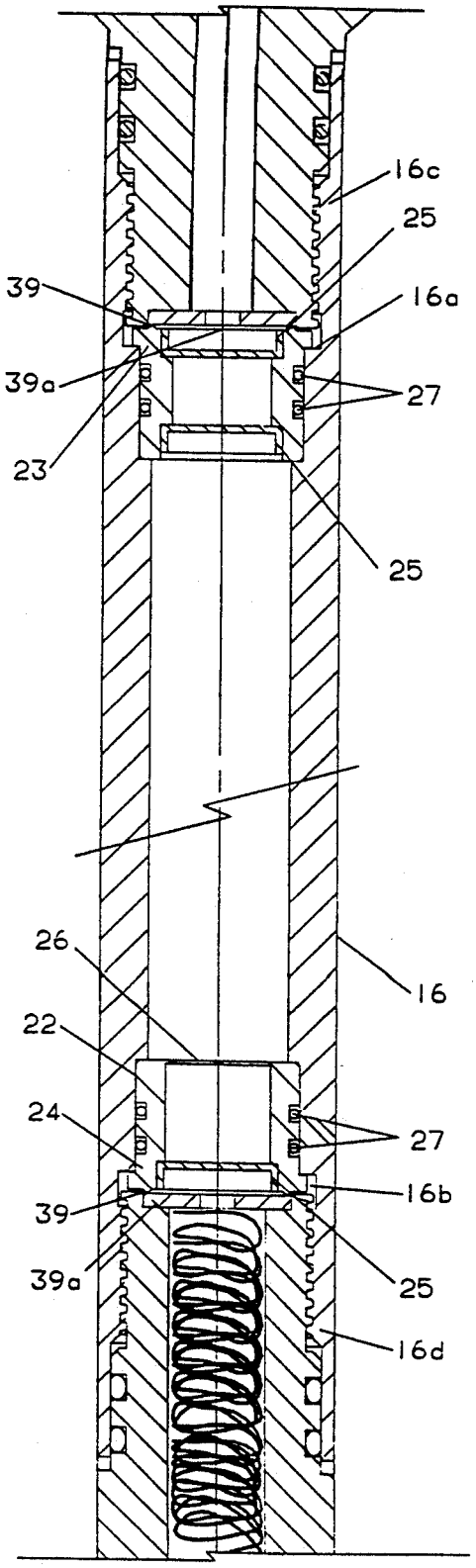
FIG. 2 is a sectional elevational view of a portion of the cutting tool illustrating the chemical section of the tool embodying the present invention.

FIG. 2 illustrates the chemical section 16 of the cutting tool in detail, illustrating two different press fit sealing assemblies 22 and 23 that function to close the bottom and top, respectively, of the chemical section 16. The two different types of sealing assemblies are shown in FIG. 2 for illustrative purposes only. The assemblies need not be different and, as a practical matter, the sealing assembly 22, which usually will be preferred, can be employed to seal the top of the chemical module as well as the bottom thereof. Two variations of the preferred embodiment are shown which are the press fit sealing assemblies 22 and 23 that function as the sealable obturators for the ends of the chemical module 14.

Figure 3:
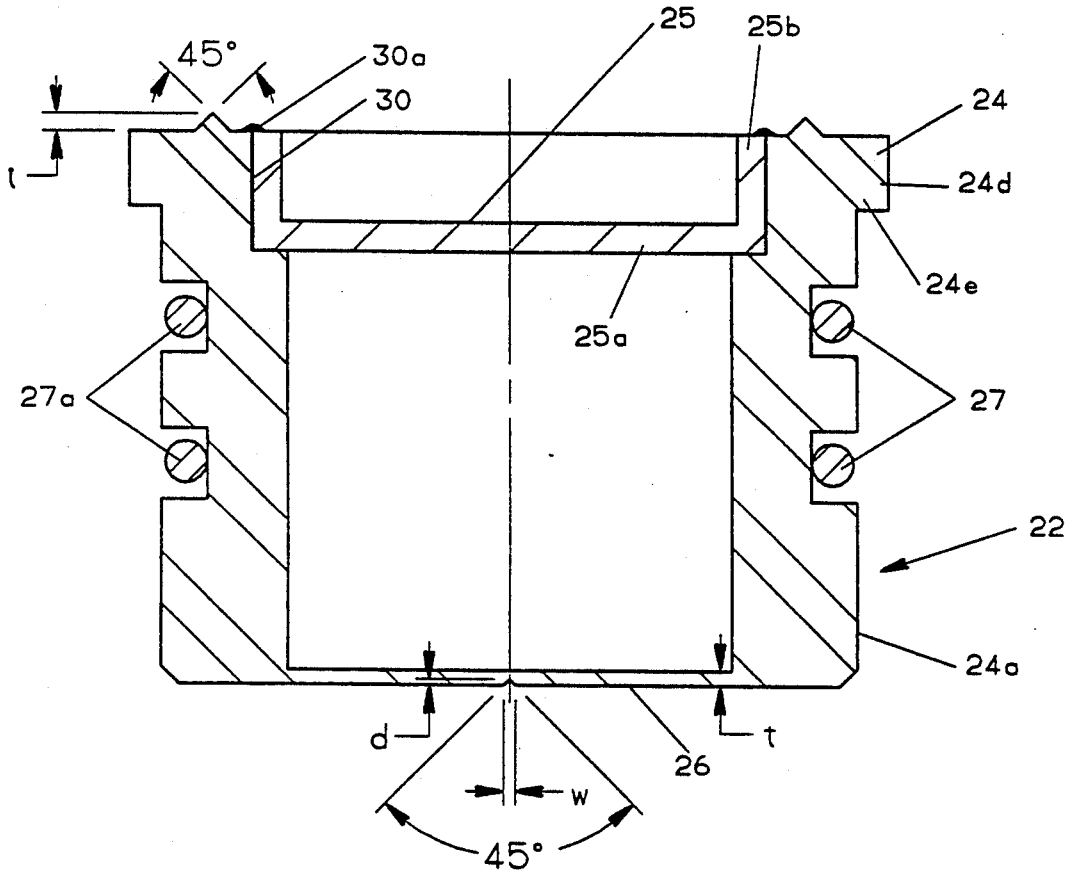
FIG. 3 is a sectional view of a preferred diaphragm assembly of the present invention.
Figure 4:
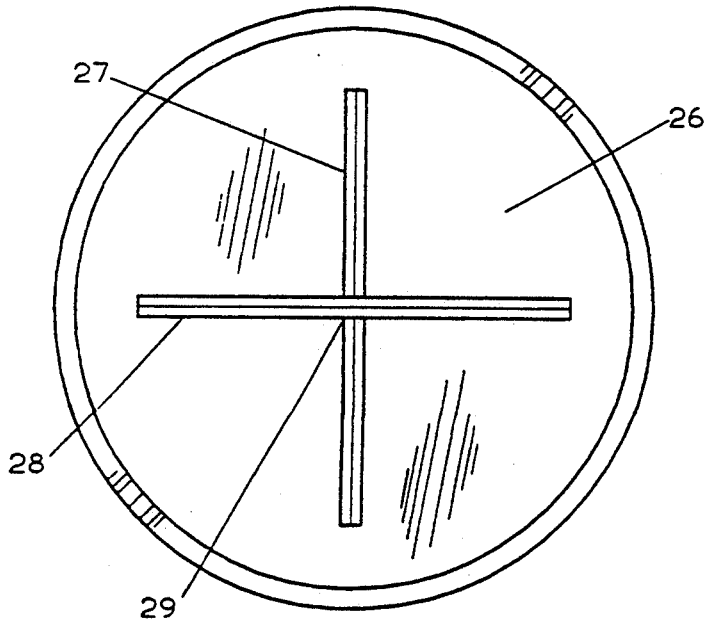
FIG. 4 is a bottom view of the diaphragm assembly shown in FIG. 3.

Turning now to FIG. 3, the press fit diaphragm assembly 22 shows a preferred form of sealing mechanism. The diaphragm body 24 is machined as a hollow, solid bottom, cylindrical cup comprising a tubular portion having an integral bottom portion 26 forming a rupture diaphragm 26. The thickness "t" of the diaphragm 26 ranges from 0.025 to 0.035 inch, where the seal body 24 is made from free machining mild steel. The bottom portion 26 of the seal body 24 serves as a primary rupture area for the diaphragm assembly 22. Referring now to FIG. 4 in conjunction with FIG. 3, there is shown a feature of the invention to assure that the bottom portion 26 ruptures reliably at a preselected pressure value. The seal bottom portion 26 is weakened to facilitate rupturing by creating a reduced cross section at a central area 29 formed at the intersection of grooves which are machined linear depressions 28 and 27. The cross section of one of the depressions or the fossa lines 27 or 28 is shown in FIG. 3 where "w" is the width of the depression and "d" is the depth of the depression. Where the seal body 24 is made from a free machining mild steel, a typical depth "d" for the slots 27 and 28 would be in the range of 0.010 to 0.012 inches and a typical width "w" for the slots 27 and 28 would be in the range of 0.015 to 0.025 inch.

A differential fluid pressure applied across the diaphragm 26 will induce a rupture due to its relative structural weakness along the lines 27 and 28 radiating outwardly to isolate triangular sections between the lines generally corresponding to the triangular sections 37 of FIG. 8, as described below.

Referring further to FIG. 3, the upper rupture diaphragm is formed as part of an insert body 25 having a diaphragm portion 25*a* and an outwardly extending rim portion 25*b*. The insert body is sealably pressed into the diaphragm retainer body 24 with 0.0005 to 0.0015 inch interference fit. That is, the outside diameter of rim portion 25*b* is about 0.0005 to 0.0015 inch larger than the inside diameter 30 of the diaphragm retainer 24. The outside rim can also serve as a ferruminate weld location 30*a* to sealably connect the rupture diaphragm 25 of the diaphragm retainer body 24. Diaphragm body 25 can be arc-welded to the retainer body 24 with a fine ferruminated weld bead 30*a* 0.025 to 0.035 inch wide. Finally, o-rings 27*a* are installed in grooves to the retainer body 24. Assembly 24 effectively functions as a seal in the end of the chemical module 16 to contain a cutting fluid such as bromine trifluoride. The diaphragm assembly 24 normally is pressed into the chemical module 14 with an interference fit of approximately 0.0005 inch, although as noted above, this interference fit can vary up to 0.0015 inch. An interference fit of a somewhat greater value would cause the metal to be scored or galled, interfering with sealing capability of the o-rings 27*a* contained in the grooves 27 for these o-rings. In the absence of o-rings, an interference fit of greater value can be used to form a metal to metal seal.

Figure 5:
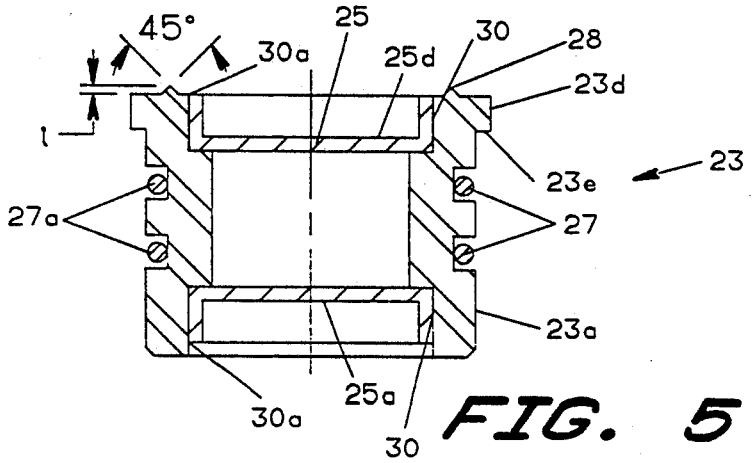
FIG. 5 is a side elevation in section showing another embodiment of an alternative form of diaphragm assembly.

Turning now to FIG. 5, this figure shows details of diaphragm assembly 23, which represents an alternative embodiment of the invention. In this embodiment, two diaphragm inserts 25 are pressed into opposite ends of the tubular seal body 23*a* with an interference fit of 0.0005 to 0.0015 inch between the two inserts 25 and the seal body 23*a*. The two diaphragm inserts 25 are then sealably connected to seal body 23 with arc-welded fine ferruminated weld beads 30*a*. O-rings 27*a* are installed in each sulcus groove 27.

Figure 6:
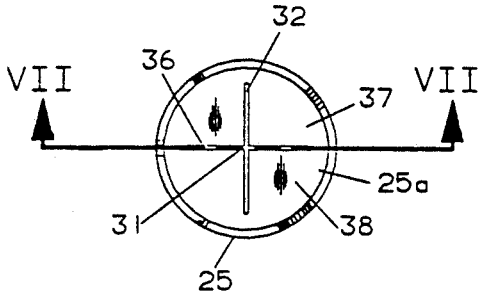
FIG. 6 is a top view of a rupture diaphragm insert of the present invention.
Figure 7:
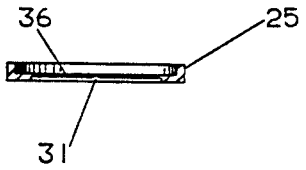
FIG. 7 is a sectional view taken along lines 7—7 of FIG. 6.
Figure 8:
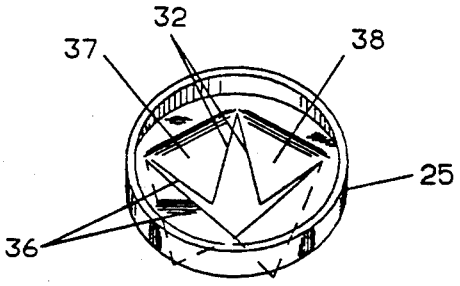
FIG. 8 is a perspective view of the rupture diaphragm assembly of FIG. 6, illustrating the ruptured configuration thereof for providing a substantially full flow opening.

The construction of rupture diaphragm 25*a* are shown in FIGS. 6, 7 and 8. As with the diaphragm 26 shown in FIG. 3, diaphragm 25*a* includes an area of reduced cross section as shown in FIG. 6 formed by means of grooves or depressions that forms a cross by stamping, cutting or similar fabrication technique. This effectively provides for rupture of the diaphragm at a closely preselected differential fluid pressure which is an important safety and reliability parameter. The pattern of the reduced cross section area is in the form of a cross having a central area 31 formed at the intersection of grooves 32 and 36. The area of reduced cross section is shown in cross section in FIG. 7, wherein it can be seen that a differential fluid pressure applied across the diaphragm will induce the intersection area 31 to first initiate rupture due to its relative structural weakness in tension. The rupture will then propagate along the grooves 32 and 36, radiating outwardly to isolate avulsed triangular sections 37 and 38 as shown in FIG. 8.

FIG. 8 illustrates a perspective view of a ruptured ductile diaphragm 25*a* with sections 37 and 38 forced downwardly along these groove lines 32 and 36 and against the side walls of the chemical module 16. This ruptured configuration may result from fluid flow therethrough, either gas or liquid, which fluid flow is essentially unrestricted subsequent to said rupture. Since the diaphragm 25*a* ruptures in tension along the aforesaid lines 32 and 36, no fragments of the rupture diaphragm are left in the chemical cutter to interfere with fluid flow.

Returning to FIG. 2 of the drawings, the upper and lower portions of the chemical section casing 16 has upper and lower interior annular shoulders 16*a* and 16*b*. Internally threaded connecting boxes 16*c* and 16*d* extend outwardly (upwardly in the case of 16*c* and downwardly in the case of 16*d*) away from the interior shoulders. These boxes, of course, receive the externally threaded pins from the upper and lower tool sections adjacent the chemical section. As further shown in FIGS. 3 and 5, the tubular seal bodies 24*a* and 23*a* are provided with enlarged diameter portions 24*d* and 23*d* to provide upset shoulders 24*e* and 23*e*. The shoulders 23*e* and 24*e* rest on the interior shoulders 16*a* and 16*b* of the chemical section casing as shown in FIG. 2. Each of the diaphragm bodies further comprise an annular sealing ridge 39 on the enlarged diameter portions 23*d* and 24*d*. In assembling the tool, a soft metal washer 39 formed of copper or the like is provided at either end of the pin connections so as to form with the rims 39 a good sealable boundary above the ferruminated weld beads 30*a* as shown in FIGS. 3 and 5. By way of example, the annular ridges 39 may be offset from the top surface of the enlarged diameter portions by about 0.063 inch with the sides thereof at an angle of 45° with the upper enlarged portion surfaces.

Having described specific embodiments of the present invention, it will be understood that modifications thereof may be suggested to those skilled in the art, and it is intended to cover all such modifications as fall within the scope of the appended claims.

I claim:

1. In a downhole chemical cutting tool having an elongated tool body adapted to be inserted into a conduit and positioned at a downhole location thereof for effecting a cutting action in said conduit, the combination comprising:

a) anchoring means in said elongated tool body for anchoring said cutting tool within a conduit;

b) a pressure generating section within said tool body;

c) a cutting section in said tool body having a longitudinal bore therein and having at least one cutting port through which cutting agent may be dispelled from said bore to the exterior of said elongated tool body;

d) a chemical section in said tool body interposed between said pressure generating section and said cutting section, said chemical section including a casing having a chamber therein adapted to contain a source of fluid chemical cutting agent; and e) closure means at least one end of said casing for closing said chamber, said closure means comprising a diaphragm body inserted into said one end of said casing by an interference fit between said diaphragm body and said one end of said casing and having at least one rupture diaphragm.

2. The combination of claim 1, further comprising second closure means at the other end of said casing, said second closure means comprising a second diaphragm body inserted into the other end of said casing by an interference fit between said second diaphragm body and said other end of said casing and comprising at least one rupture diaphragm.

3. The combination of claim 1, wherein said rupture diaphragm fits into said diaphragm body in an interference fit.

4. The combination of claim 1, wherein said at least one rupture diaphragm is formed integrally with said diaphragm body and is scored to facilitate rupturing thereof.

5. The combination of claim 1, wherein said diaphragm body comprises at least two longitudinally spaced rupture diaphragms.

6. The combination of claim 5, wherein at least one of said longitudinally spaced diaphragms fits into said diaphragm body in an interference fit.

7. The combination of claim 6, wherein another of said longitudinally spaced diaphragms is formed integrally with said diaphragm body and is scored to facilitate rupturing thereof.

8. The combination of claim 5, further comprising second closure means at the other end of said casing, said second closure means comprising a second diaphragm body inserted into the other end of said casing by an interference fit and comprising at least two longitudinally spaced diaphragms.

9. The combination of claim 5, where said chemical section casing has an internal annular shoulder at at least one end thereof and said diaphragm body comprises a reduced diameter portion and an enlarged diameter portion defining an upset should at one end of said reduced diameter portion wherein said reduced diameter section fits into said casing in an interference fit and said upset shoulder is in an abutting relationship with said internal casing shoulder.

10. The combination of claim 9, where said chemical section casing has an internally threaded connecting box extending outwardly from said shoulder.

11. The combination of claim 10, wherein said diaphragm body comprises an annular sealing ridge on said enlarged diameter portion projecting upwardly therefrom and outwardly therefrom and spaced inwardly of said connecting box.

12. The combination of claim 9, wherein said chemical section casing has an internal annular at the other end thereof and further comprising said diaphragm body further comprising a second diaphragm body inserted into said casing at said other end by an interference fit and comprising at least two longitudinally spaced rupture diaphragms, a reduced diameter portion and an enlarged diameter portion defining an upset shoulder at one end of said reduced diameter portion wherein said reduced diameter section fits into said casing in an interference fit and said upset shoulder is in an abutting relationship with said internal casing shoulder.

13. In a downhole chemical cutting tool having an elongated tool body adapted to be inserted into a conduit and positioned at a downhole location thereof for effecting a cutting action in said conduit, the combination comprising:

a) anchoring means in said elongated tool body for anchoring said cutting tool within a conduit;
b) a pressure generating section within said tool body;
c) a cutting section in said tool body having a longitudinal bore therein and having at least one cutting port through which cutting agent may be dispelled from said bore to the exterior of said elongated tool body;
d) a chemical section in said tool body interposed between said pressure generating section and said cutting section, said chemical section including a casing having a chamber therein adapted to contain a source of fluid chemical cutting agent; and
e) a tubular closure body inserted into one end of said casing by an interference fit between the outer surface of said tubular body and the inner surface of said casing;
f) a first rupture diaphragm extending transversely across the interior of said tubular body; and
g) a second rupture diaphragm extending transversely across the interior of said tubular body and spaced longitudinally inwardly along said tubular body from said first diaphragm.

14. The combination of claim 13, wherein said first rupture diaphragm is formed in an insert body having a rim portion extending outwardly from said first diaphragm and in an interference fit with said tubular closure body.

15. The combination of claim 14, wherein said second rupture diaphragm is formed in a second insert body having a ring portion and in an interference fit with said tubular closure body extending from said second rupture diaphragm in the opposite direction of said first diaphragm.

16. The combination of claim 13, wherein said chemical section casing has an internal annular shoulder at at least one end thereof and said tubular closure body comprises a reduced diameter portion extending into said casing in an interference fit and an enlarged diameter portion defining an upset shoulder at the outer end of said reduced diameter portion wherein said reduced diameter section is in an abutting relationship with said shoulder on said casing.

17. The combination of claim 13, wherein said tubular closure body comprises an annular sealing ridge on said enlarged diameter portion projecting upwardly therefrom and surrounding said first rupture diaphragm.

18. The combination of claim 17, wherein said chemical section casing has an internally threaded connecting box extending outwardly from said shoulder and surrounding said sealing ridge.

19. The combination of claim 13, further comprising a second tubular body inserted into the other end of said casing by an interference fit, a first diaphragm extending transversely of said tubular body and a second rupture diaphragm extending transversely of said tubular body and spaced longitudinally inwardly along said tubular body from said first diaphragm.

20. In a downhole chemical cutting tool having an elongated tool body adapted to be inserted into a conduit and positioned at a downhole location thereof for effecting a cutting action in said conduit, the combination comprising:

a) anchoring means in said elongated tool body for anchoring said cutting tool within a conduit;
b) a pressure generating section within said tool body;
c) a cutting section in said tool body having a longitudinal bore therein and having at least one cutting port through which cutting agent may be dispelled from said bore to the exterior of said elongated tool body;
d) a chemical section in said tool body interposed between said pressure generating section and said cutting section, said chemical section including a casing having a chamber therein adapted to contain a source of fluid chemical cutting agent; and
e) a tubular closure body inserted into one end of said casing by an interference fit between the outer surface of said tubular body and the inner surface of said casing;
f) a first rupture diaphragm extending transversely across the interior of said tubular closure and formed in an insert body having a rim portion extending outwardly from said first diaphragm and in an interference fit with said tubular closure body; and
g) a second rupture diaphragm extending transversely across the interior of said tubular body and spaced longitudinally inwardly along said tubular body from said first diaphragm and formed integrally with said tubular closure body.

21. The combination of claim 20, wherein said second rupture diaphragm is scored to facilitate rupturing thereof.

* * * * *